US009789945B1

(12) United States Patent
Vaninetti et al.

(10) Patent No.: US 9,789,945 B1
(45) Date of Patent: Oct. 17, 2017

(54) ANGULARLY ADJUSTABLE TILLERS FOR OUTBOARD MOTORS

(71) Applicant: Brunswick Corporation, Lake Forest, IL (US)

(72) Inventors: Travis J. Vaninetti, Neenah, WI (US); Jeffrey A. Zarembka, Plymouth, WI (US); Wayne M. Jaszewski, Jackson, WI (US); Peter Pickett, Stillwater, OK (US); Timothy S. Reid, Eden, WI (US); Randall J. Poirier, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/254,528

(22) Filed: Sep. 1, 2016

Related U.S. Application Data

(63) Continuation-in-part of application No. 15/236,534, filed on Aug. 15, 2016.

(51) Int. Cl.
*B63H 20/12* (2006.01)
*B63H 21/21* (2006.01)
*B63H 20/00* (2006.01)

(52) U.S. Cl.
CPC ..... *B63H 21/213* (2013.01); *B63H 20/12* (2013.01); *B63H 21/265* (2013.01)

(58) Field of Classification Search
CPC ..... B63H 20/00; B63H 20/08; B63H 20/12; B63H 20/20; B63H 21/21; B63H 5/125; B63H 21/17
USPC ..... 440/53, 84, 87
See application file for complete search history.

(56) References Cited

U.S. PATENT DOCUMENTS

| | | | | |
|---|---|---|---|---|
| 3,636,911 | A | 1/1972 | Piazza | |
| D276,811 | S | 12/1984 | Wolfe | |
| 4,496,326 | A | 1/1985 | Boda | |
| 4,521,201 | A * | 6/1985 | Watanabe | B63H 21/265 440/55 |
| 4,582,493 | A | 4/1986 | Toyohara | |
| 4,650,429 | A | 3/1987 | Boda | |
| 4,701,141 | A * | 10/1987 | Sumigawa | B63H 21/265 440/55 |
| D295,867 | S | 5/1988 | Walsh | |
| 4,878,468 | A | 11/1989 | Boda et al. | |
| 5,340,342 | A | 8/1994 | Boda et al. | |
| 5,632,657 | A | 5/1997 | Henderson | |
| D380,478 | S | 7/1997 | Robbins | |
| 6,010,563 | A | 1/2000 | Risk, Jr. | |
| 6,093,066 | A | 7/2000 | Isogawa | |
| 6,146,221 | A * | 11/2000 | Natsume | B63H 20/12 440/53 |
| 6,264,516 | B1 | 7/2001 | McEathron et al. | |

(Continued)

*Primary Examiner* — Lars A Olson
(74) *Attorney, Agent, or Firm* — Andrus Intellectual Property Law, LLP

(57) ABSTRACT

A tiller is for an outboard motor. The tiller has a base bracket that is configured to be rotationally fixed with respect to the outboard motor, a chassis bracket that is coupled to the base bracket, and a locking arrangement. The locking arrangement is movable into and between a locked position, wherein the chassis bracket is locked to and rotates together with the base bracket, and an unlocked position, wherein the chassis bracket is freely rotatable with respect to the base bracket about a vertical axis when the tiller is in a horizontal position.

15 Claims, 15 Drawing Sheets

(56) References Cited

U.S. PATENT DOCUMENTS

| | | | | |
|---|---|---|---|---|
| 6,406,342 | B1 | 6/2002 | Walczak et al. | |
| 6,902,450 | B2 * | 6/2005 | Ohtsuki | B63H 20/12 440/84 |
| 7,090,551 | B1 | 8/2006 | Lokken et al. | |
| D527,737 | S | 9/2006 | Iekura | |
| 7,214,113 | B2 | 5/2007 | Kojima | |
| D552,129 | S | 10/2007 | Steinberg | |
| 7,455,558 | B2 * | 11/2008 | Yander | B63H 20/007 440/53 |
| D611,501 | S | 3/2010 | Vignau et al. | |
| D611,502 | S | 3/2010 | Vignau et al. | |
| 7,677,938 | B2 | 3/2010 | Wiatrowski et al. | |
| 7,704,110 | B2 | 4/2010 | Wiatrowski et al. | |
| 7,895,959 | B1 | 3/2011 | Angel et al. | |
| D655,308 | S | 3/2012 | Steinberg | |
| 8,257,122 | B1 | 9/2012 | Holley | |
| 9,422,045 | B2 | 8/2016 | Kinpara | |

* cited by examiner

ANGULARLY ADJUSTABLE TILLERS FOR OUTBOARD MOTORS

CROSS-REFERENCE TO RELATED APPLICATION

This application is a Continuation-In-Part of and claims priority to U.S. patent application Ser. No. 15/236,534, filed Aug. 15, 2016, which is incorporated herein by reference in entirety.

FIELD

The present disclosure relates to outboard motors, and particularly to tillers for outboard motors.

BACKGROUND

The following U.S. Patents are incorporated herein by reference, in entirety:

U.S. Pat. No. 8,257,122 discloses a multi-function throttle shaft that combines motor speed-control and motor direction-control in one tiller handle. Co-functionally, the throttle shaft is rotated clockwise/counterclockwise to control motor speed while intuitively allowing the user to push the throttle in for reverse direction and pull the throttle out for forward direction or vise-versa, based on whether the trolling motor is mounted on the transom or bow of a boat. In either case, the handle is always moved in the same direction that the operator wants the boat to travel.

U.S. Pat. No. 7,895,959 discloses advanced steering system designs for marine vessels which incorporate non-linear tiller arms for rudder control, designed for creating different turning radii for discrete rudders. Differential tillers are utilized to create distinct angular displacement of the separate rudders in turning maneuvers, which enhance control and maneuverability of the marine vessels.

U.S. Pat. No. 7,090,551 discloses a tiller arm provided with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

U.S. Pat. No. 6,406,342 discloses a control handle for a tiller of an outboard motor provided with a rotatable handle grip portion that includes an end surface which supports a plurality of push buttons that the operator of a marine vessel can depress to actuate certain control mechanisms and devices associated with the outboard motor. These push buttons include trim up and trim down along with gear selector push buttons.

U.S. Pat. No. 6,264,516 discloses an outboard motor provided with a tiller handle that enables an operator to control the transmission gear selection and the throttle setting by rotating the hand grip of the tiller handle. It also comprises a means for allowing the operator to disengage the gear selecting mechanism from the throttle mechanism. This allows the operator to manipulate the throttle setting without having to change the gear setting from neutral position.

U.S. Pat. No. 5,632,657 discloses a movable handle mounted to a trolling motor head. The handle is pivotally adjustable upwardly and downwardly to suit different positions of a fisherman while controlling the trolling motor. The handle spans across the motor head and acts as a tiller for pivoting the motor about its axis. The resistance to positional changes is adjustable and protective features are provided to prevent damage to the adjustment mechanism in the event of tightening. The handle incorporates therein various controls for the motor head.

U.S. Pat. No. 5,340,342 discloses a tiller handle provided for use with one or more push-pull cables inter-connected to the shift and the throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the throttle mechanisms of the engine.

U.S. Pat. No. 4,878,468 discloses an outboard marine motor housed by a cowl assembly having an upper cowl section and a lower cowl section. The cowl assembly includes various features for improving the structural integrity of the cowl assembly and for providing a water-resistant seal at the joint between the cowl sections and at various points of entry of cables and other mechanical devices. A cut-out portion in the side of the lower cowl assembly is adapted to receive various cables and shift levers for different configurations of outboard marine motors, e.g. a manual tiller-operated motor including shift controls, a manual tiller-operated motor having a separate shift lever, and a remote-control motor having throttle and shift cables leading into the engine cavity. A sealing mechanism is provided at the cut-out portion of the lower cowl assembly, to provide a water-resistant seal at the points of entry of the cables or shift lever through the lower cowl section.

U.S. Pat. No. 4,496,326 discloses a steering system for a marine drive having a propulsion unit pivotally mounted on the transom of a watercraft and a tiller. The steering system includes a steering vane rotatably mounted on the propulsion unit for generating hydrodynamic forces to pivot or assist in pivoting the propulsion unit and to counteract propeller torque. An adjustable mount interposed between the propulsion unit and the tiller mounts the tiller for movement relative to the propulsion unit. A cable connects the tiller to the steering vane so that movement of the tiller with respect to the propulsion unit rotates the vane. The adjustable mount includes mutually engageable elements that can lock the tiller against movement relative to the propulsion unit so that the tiller may be used to directly steer the propulsion unit, if desired. For this purpose, the elements of the adjustable mount may be engaged by applying a downward pressure on the tiller.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a tiller is for an outboard motor. The tiller has a base bracket that is configured to be rotationally fixed with respect to the outboard motor, a chassis bracket that is coupled to the base bracket, and a locking arrangement that is movable into and between a locked position wherein the chassis bracket is locked to and rotates together with the base bracket, and an unlocked position wherein the chassis bracket is freely rotatable with respect to the base bracket about a vertical axis when the tiller is in a horizontal position. In other examples, a tiller comprises a bushing configured for mounting on the base bracket in a first position wherein the bushing couples the tiller chassis to the base bracket such that the tiller chassis extends at a first angle with respect to the base bracket, and in a second position wherein the bushing couples the tiller chassis to the base bracket at a different, second angle with respect to the base bracket.

BRIEF DESCRIPTION OF THE DRAWINGS

The present disclosure is described with reference to the following Figures. The same numbers are used throughout the figures to reference like features and like components.

DETAILED DESCRIPTION OF THE DRAWINGS

Figure 1:
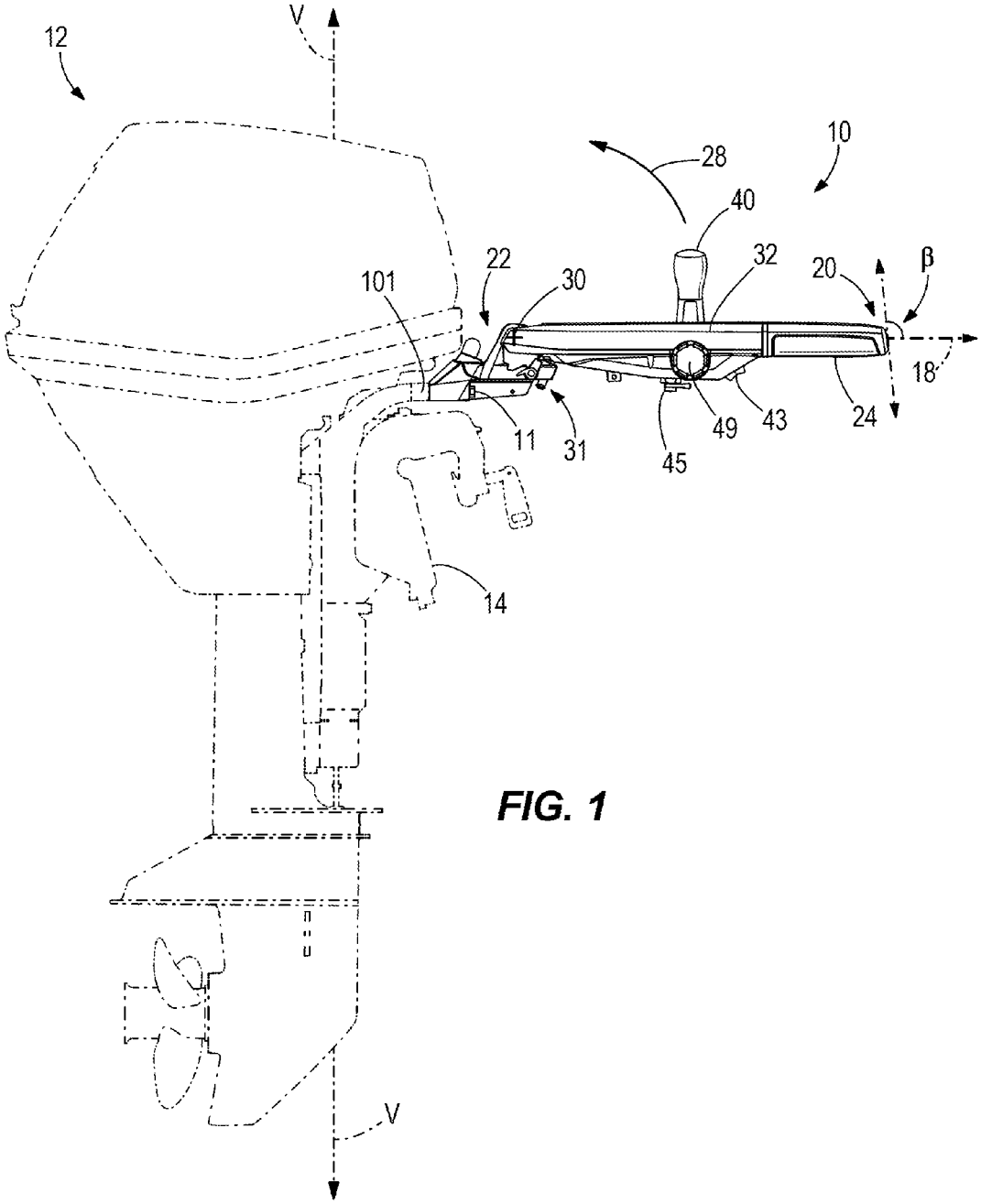
FIG. 1 is a side view of an outboard motor and a tiller according to the present disclosure.

FIG. 1 depicts a tiller 10 for use with an outboard motor 12. The tiller 10 is illustrated in solid line format and the outboard motor 12 is illustrated in dash-and-dot line format. The configuration of outboard motor 12 is exemplary and can vary from what is shown. In the illustrated example, the outboard motor 12 is configured for attachment to the transom of a marine vessel via a transom bracket 14 such that the outboard motor 12 is steerable about a vertical steering axis V, as is conventional.

Figure 2:
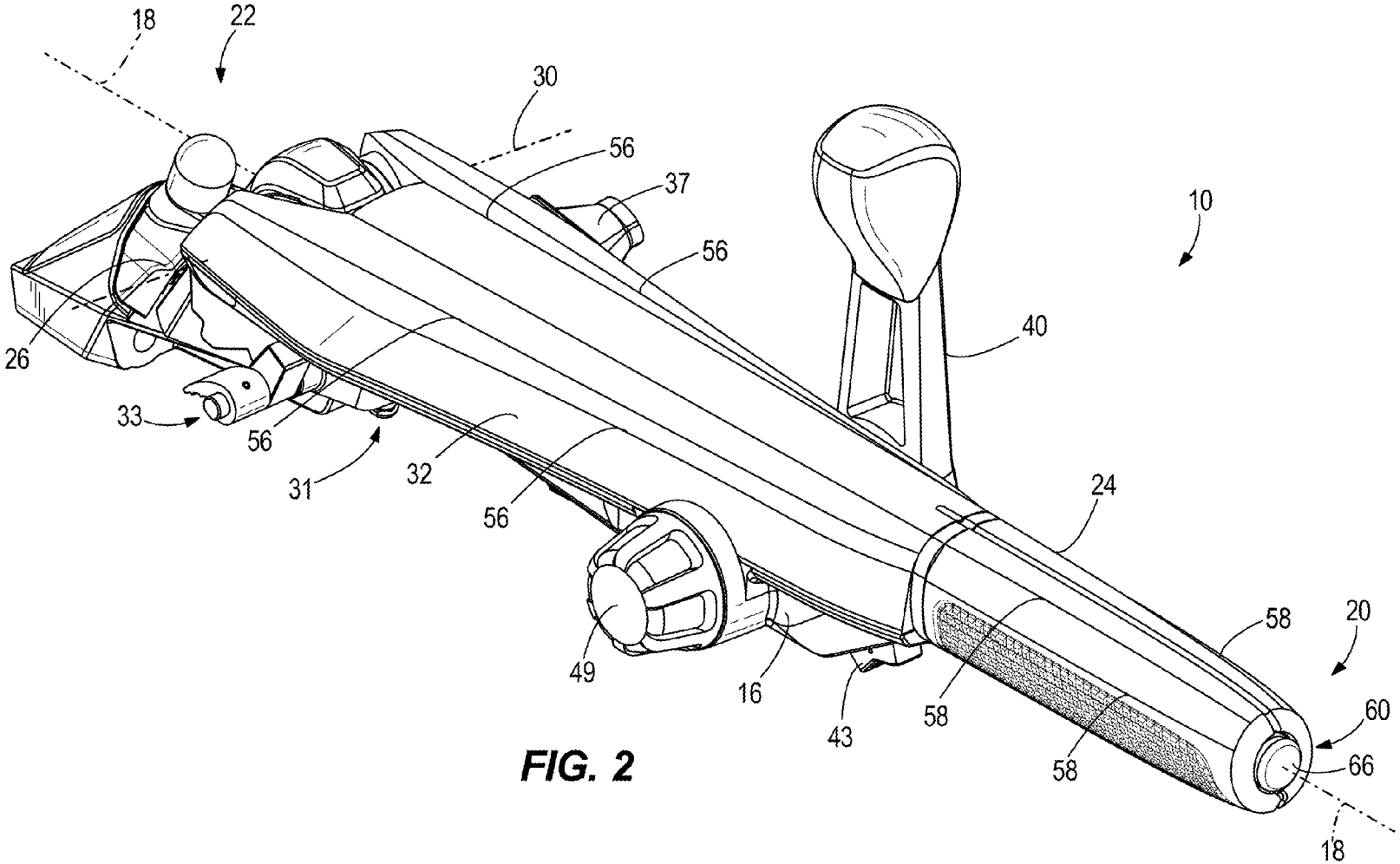
FIG. 2 is a perspective view of the tiller in a horizontal position.
Figure 3:
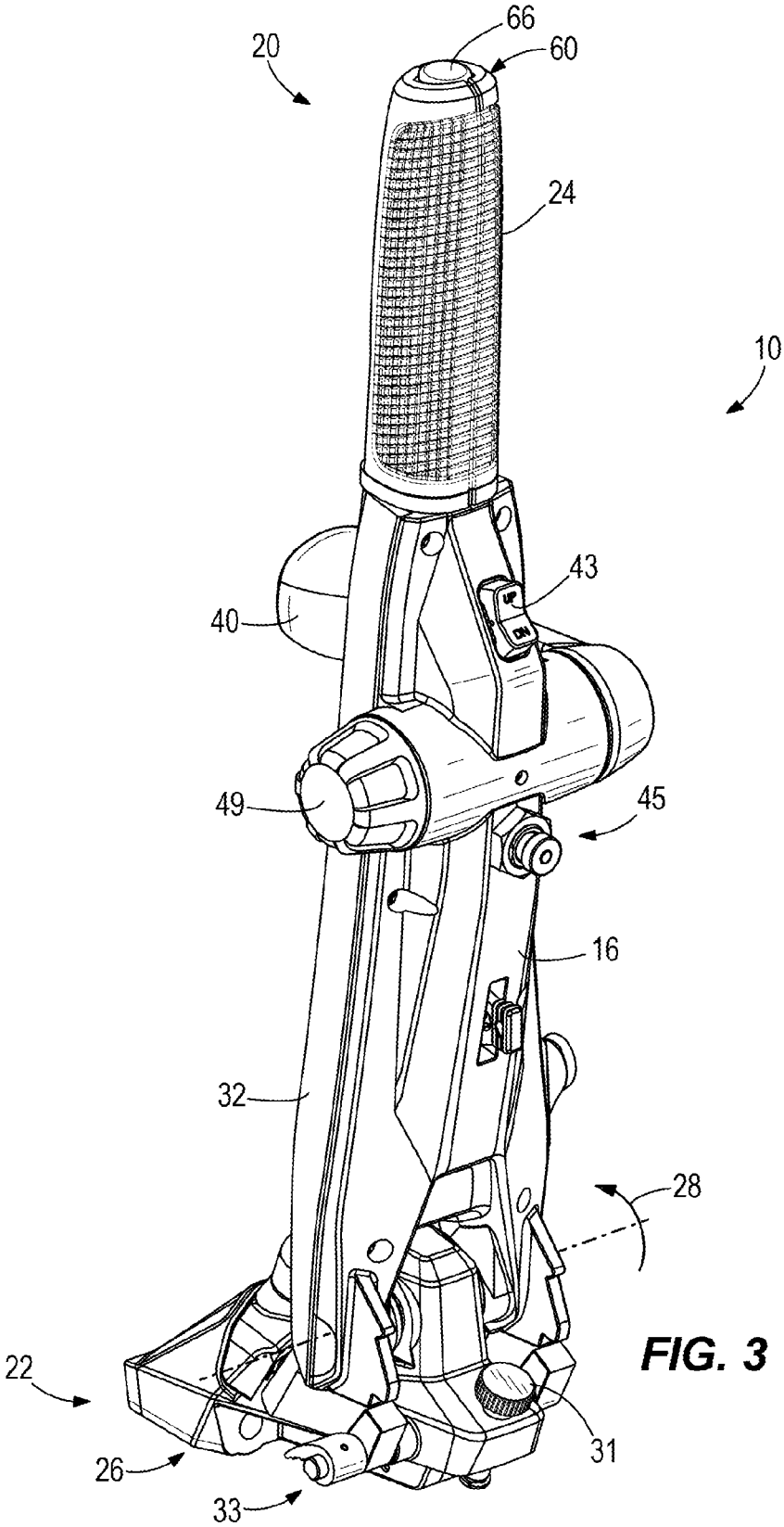
FIG. 3 is a perspective view of the tiller in a vertical position.

Referring to FIGS. 2-5, the tiller 10 has a supporting chassis 16 that extends in an axial direction along a tiller axis 18. The supporting chassis 16 has a first axial end 20 and an axially opposite, second axial end 22. A rotatable throttle grip 24 is supported on the first axial end 20. An adjustable mount 26 is located at the second axial end 22, and is configured to facilitate pivoting of the tiller 10 through a range of motion 28 (FIGS. 1 and 3) including at least into and between a horizontal position (FIG. 2) where in the supporting chassis 16 extends horizontally and a vertical position (FIG. 3) where in the supporting chassis 16 extends vertically. In certain examples, the supporting chassis 16 is made of metal. The type and configuration of adjustable mount 26 can vary from what is shown, and for example can include any one or a combination of adjustable mount embodiments, several of which are detailed herein below. As is conventional, the adjustable mount 26 allows for pivoting of the tiller 10 through the range of motion 28 about a horizontal pivot axis 30 (FIG. 2). An optional adjustment bolt 31 and ratchet lever 33 are located at the adjustable mount 26 and facilitate positional and pivoting movement, as is conventional.

Figure 4:
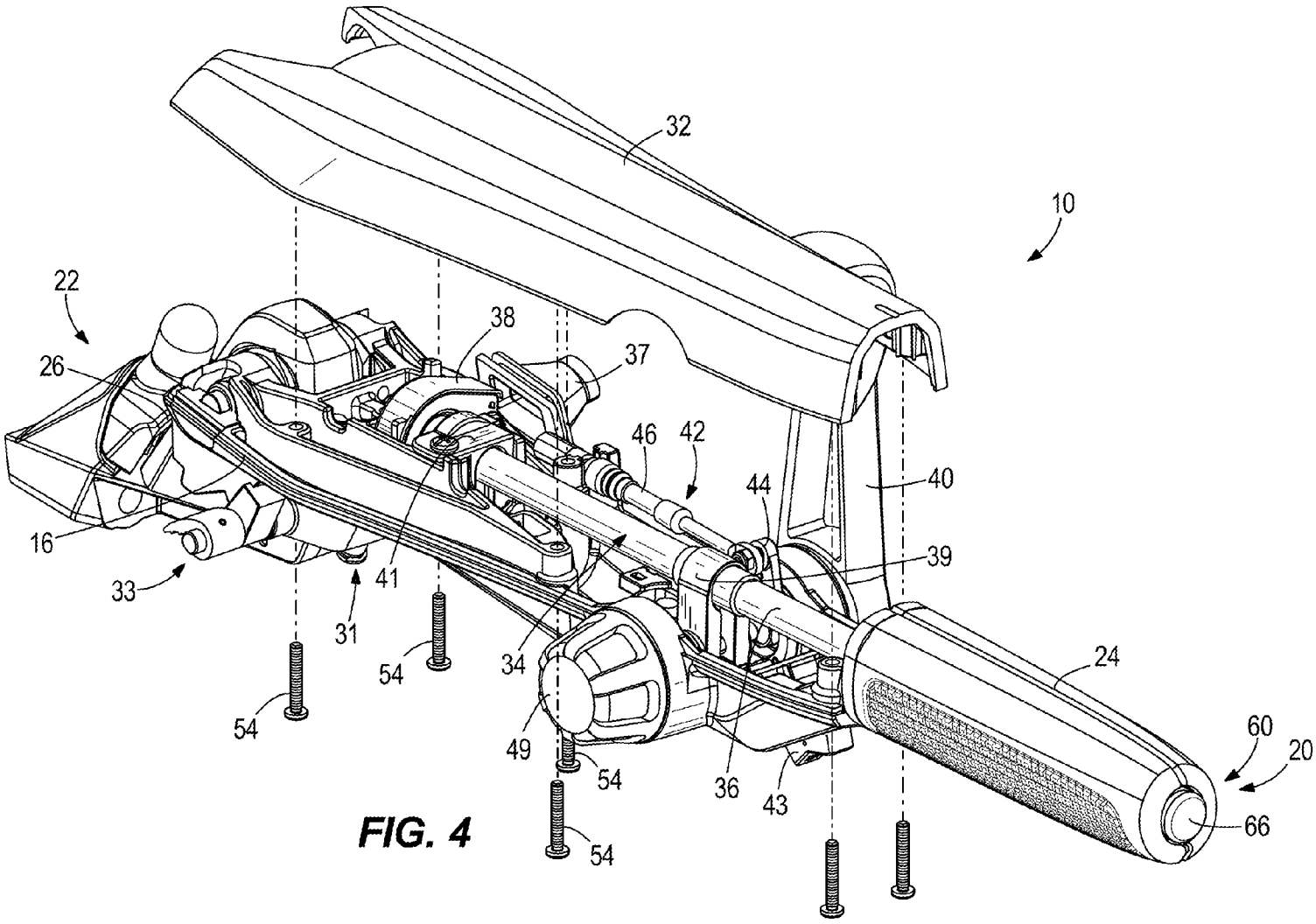
FIG. 4 is a perspective view of the tiller having the top cover removed.
Figure 5:
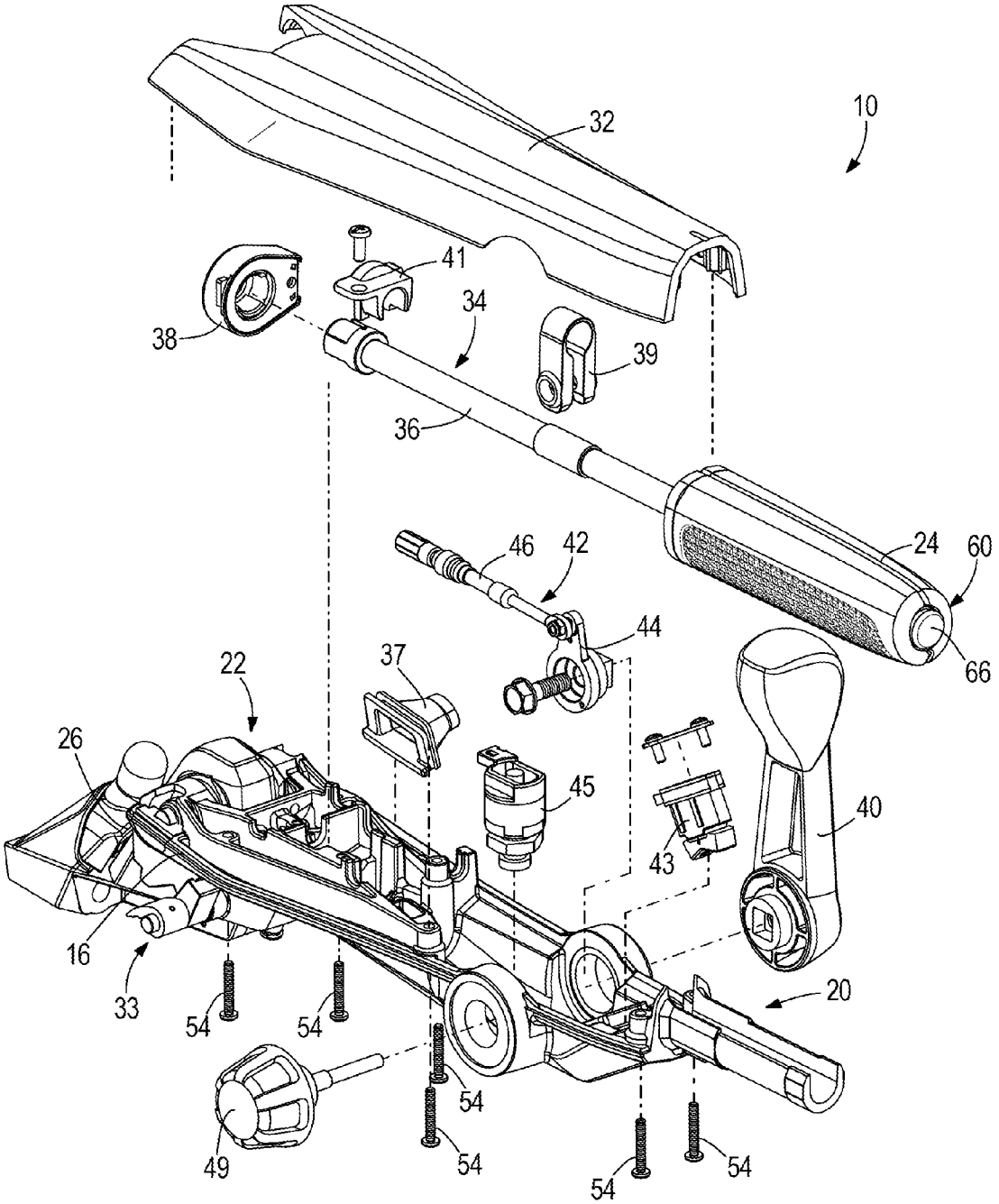
FIG. 5 is an exploded view of the tiller.

A top cover 32 is disposed on top of the supporting chassis 16. The top cover 32 and supporting chassis 16 together define an interior of the tiller 10. The top cover 32 is particularly located on top of the supporting chassis 16 when the tiller 10 is in the horizontal position (FIG. 2). Advantageously, the top cover 32 is removable from the supporting chassis 16 when the tiller 10 is in the horizontal position (FIG. 2). Thus, as illustrated in FIG. 4, removal of the top cover 32 provides access to the interior from above the tiller 10 when the tiller 10 is in the horizontal position (FIG. 2). This advantageously provides access to the interior in a more ergonomic and less awkward position compared to the prior art. In certain examples, the top cover 32 is made of plastic. Referring to FIG. 5, the top cover 32 is coupled to the supporting chassis 16 by removable fasteners 54. Removal of the fasteners 54 allows removable of the top cover 32 from the supporting chassis 16. In other examples, the top cover 32 is removably fastened to the supporting chassis 16 by a snap-fit engagement or other non-permanent connection. Advantageously the fasteners 54 are inserted from below the tiller 10 in the horizontal position. Thus the fasteners 54 remain hidden from view in the horizontal position, providing an aesthetically pleasing appearance Referring to FIG. 5, the tiller 10 has a throttle linkage 34 that links the rotatable throttle grip 24 to a throttle (not shown) on the outboard motor 12, as is conventional. The throttle linkage 34 includes a throttle shaft 36 that is disposed in the interior of the tiller 10 such that the supporting chassis 16 is located vertically beneath and supports the throttle shaft 36 when the tiller 10 is in the horizontal position (FIG. 2). The throttle shaft 36 thus extends parallel to the tiller axis 18 and is held in place by a mounting sleeve 39 and a hold-down bracket 41. Rotation of the rotatable throttle grip 24 causes rotation of the throttle shaft 36. A rotatable locking knob 49 is coupled to the mounting sleeve 39. Rotation of the locking knob 49 in one direction squeezes the mounting sleeve 39 to lock the position of the throttle shaft 36 and rotatable throttle grip 24 thus facilitating hands-free operation. Opposite rotation of the locking knob 49 relaxes the mounting sleeve 39 and thus allows manual rotation of the rotatable throttle grip 24 and associated throttle shaft 36.

The throttle linkage 34 further includes a throttle pulley 38, which is also disposed in the interior of the tiller 10 such that the supporting chassis 16 is located vertically beneath and supports the throttle pulley 38 when the tiller 10 is in the horizontal position (FIG. 2). The throttle pulley 38 is configured for connection to throttle cables (not shown), which extend through a grommet 37 in the supporting chassis 16 to a corresponding pulley on the throttle of the outboard motor (not shown). Rotation of the rotatable throttle grip 24 thus causes rotation of the throttle shaft 36, which rotates the throttle pulley 38, causing corresponding pulling motion on the noted throttle cables and corresponding pulley on the throttle of the outboard motor 12.

A manual shift lever 40 is coupled to the supporting chassis 16. A shift linkage 42 links the manual shift lever 40 to a transmission (not shown) on the outboard motor 12. The shift linkage 42 includes a shift link 44 that is disposed in the interior of the tiller 10 such that the supporting chassis 16 is located vertically beneath and supports the shift link 44 when the tiller 10 is in the horizontal position (FIG. 2). Manual shifting of the shift lever 40 causes corresponding rotation of the shift link 44, which translates a push cable 46. Translation of the push cable 46 causes corresponding shifting action in the transmission of the outboard motor 12, as is conventional.

Optional tiller components can be supported by the supporting chassis 16, including a manual trim switch 43 and associated circuitry, as well as a kill switch 45 and associated circuitry for shutting off the outboard motor in an emergency. The kill switch 45 is actuated by a conventional removable lanyard (not shown). These components are conventional and thus are not further described herein.

The present disclosure thus provides a tiller 10 that provides improved access for maintenance. The supporting chassis 16 is advantageously positioned on the underside of the tiller 10 in the horizontal position and underneath and supporting the internal components of the tiller 10. The easily removable top cover 32 protects the internal components of the tiller 10 and provides an aesthetically pleasing design. In use, the user simply removes the top cover 32 and can easily access the components of the tiller 10 in the horizontal position.

Figure 6:
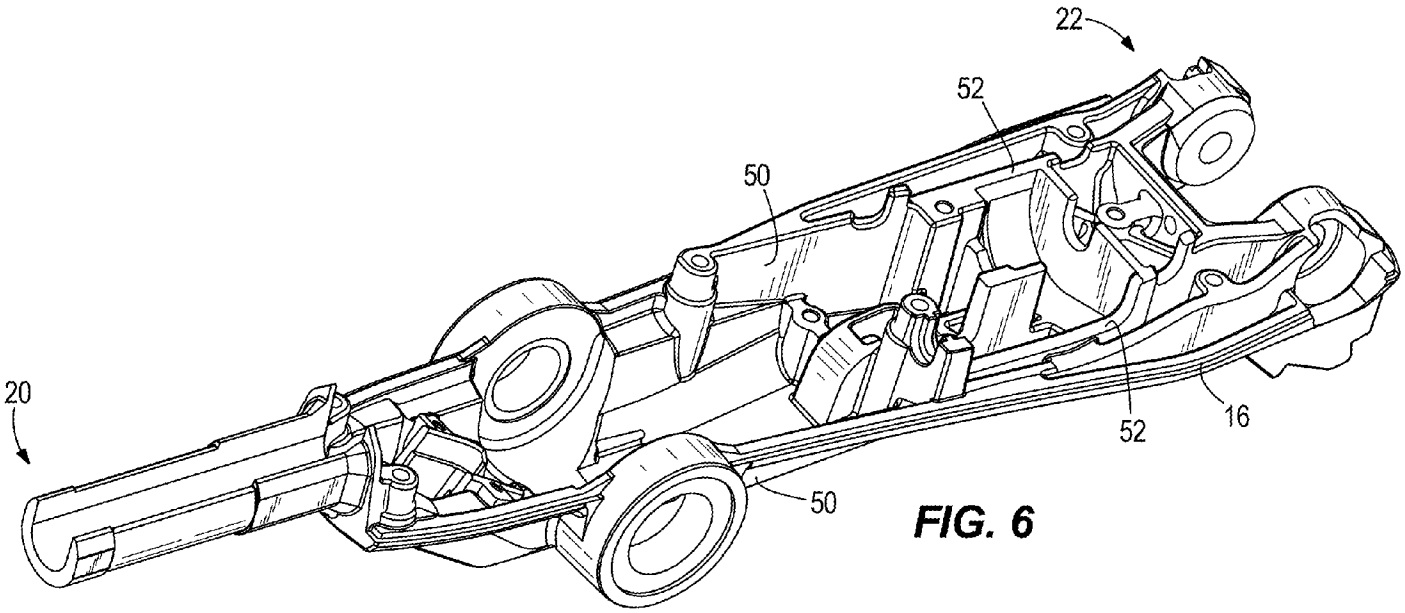
FIG. 6 is a perspective view of a supporting chassis.
Figure 7:
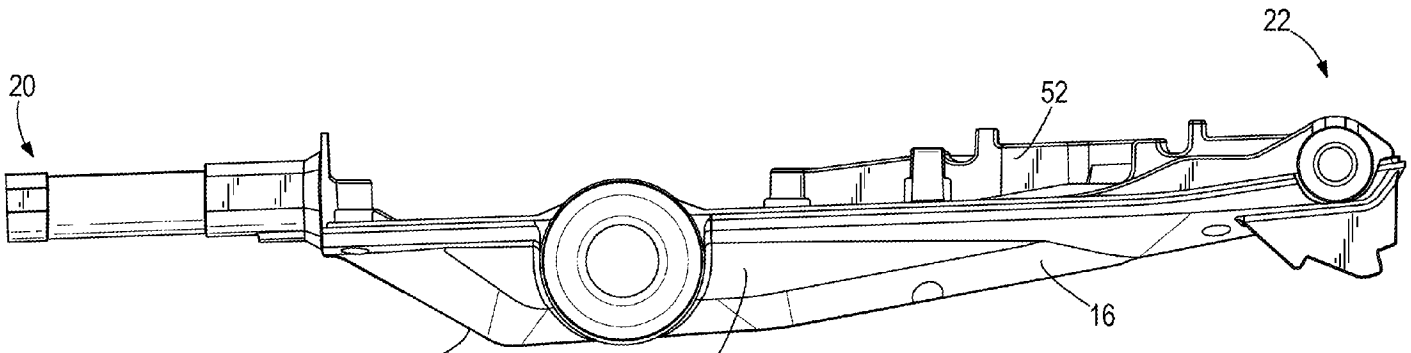
FIG. 7 is a side view of the supporting chassis.
Figure 8:
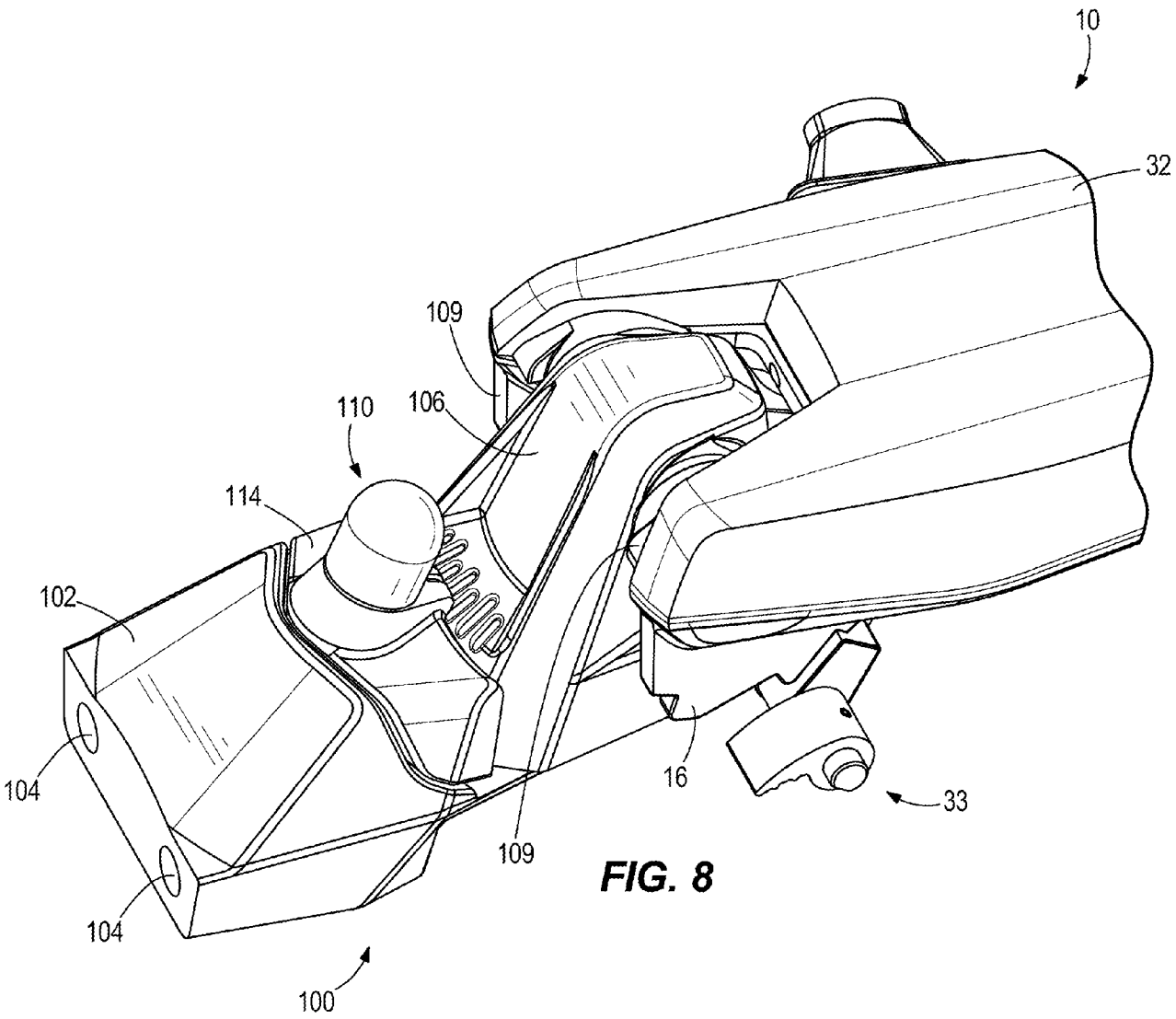
FIG. 8 is a perspective view of a first embodiment of an adjustable mount for the tiller.

As shown in FIGS. 6 and 7, the supporting chassis 16 includes a bottom wall 48 and opposing side walls 50 that extend vertically upwardly and on opposite sides of the bottom wall 48 when the tiller 10 in is the horizontal position (FIG. 2). A plurality of supporting ribs 52 is formed along the bottom wall 48. The supporting ribs 52 are located closer to the second axial end 22 and the first axial end 20. The supporting ribs 52 are advantageously configured to absorb reaction forces in the supporting chassis 16 due to a downward force applied to the first axial end 20 to the tiller 10, for example by a user placing their hand on the rotatable throttle grip 24 and pushing downwardly thereon. The supporting ribs 52 axially extend with respect to the supporting chassis and extend vertically higher than the side walls 50 when the tiller 10 is in the horizontal position, see FIGS. 2 and 7.

Referring to FIG. 2 a first set of axial alignment ribs 56 axially extends along the top cover 32. A second set of axial alignment ribs 58 extends along the rotatable throttle grip 24. The first and second sets of axial alignment ribs 56, 58 are in alignment when the rotatable throttle grip 24 is located in an idle position, see FIG. 2. In contrast, the first and second sets of axial alignments ribs 56, 58 move out of alignment with each other when the rotatable throttle grip 24 is located out of the idle position shown in FIG. 2. Advantageously, this allows the operator to see and feel the idle position on the tiller 10.

Referring to FIGS. 1 and 2, the rotatable throttle grip 24 also has a beveled end surface 60 that is set at an angle β with respect to vertical so that the beveled end surface 60 is visible from vertically above the tiller 10. The angle β provides increased visibility and easier access to a kill switch 66 located at the beveled end surface 60 when the tiller 10 is in the horizontal position.

FIGS. 8-13 depict a first embodiment of an adjustable mount 100 for attaching the supporting chassis 16 of the tiller 10 to the outboard motor 12. As further explained herein below, the adjustable mount 100 advantageously allows the operator to manually reposition the tiller 10 about a vertical axis 113 (see FIGS. 11-13) with respect to the outboard motor 12, so that the tiller 10 can be fixed at any one of a plurality of fixed angles with respect to the outboard motor 12, including a neutral position (see FIG. 11) and a variety of different left-handed and right-handed tiller positions (e.g., compare FIGS. 12 and 13).

The adjustable mount 100 includes a base bracket 102 configured to be rotationally fixed with respect to the outboard motor 12. The manner in which the base bracket 102 is rotationally fixed to the outboard motor 12 can vary from what is shown. In the illustrated example, the base bracket 102 is fastened to a steering arm 101 (see FIG. 1) on the outboard motor 12. The manner in which the base bracket 102 is fixed to the steering arm 101 can also vary from what is shown. In the illustrated example, the base bracket 102 is fixed to the steering arm via fasteners 11 (see FIG. 1) that extend through holes 104 (see FIG. 8) in the base bracket 102 and corresponding holes in the steering arm. In the illustrated example, the fasteners 11 include threaded bolts.

The adjustable mount 100 also includes a chassis bracket 106 configured to couple the tiller chassis 16 to the base bracket 102 such that the tiller chassis 16 can be selectively rotated with respect to the base bracket 102 and associated outboard motor 12 about a vertical axis when the tiller 10 is in the horizontal position. The manner in which the chassis bracket 106 is coupled to the tiller chassis 16 can vary from what is shown. In the illustrated example, the chassis bracket 106 has a lateral through-bore 117 (FIGS. 11-13) for supporting a tilt shaft (not shown) having opposite ends connected to opposing arms 109 of the tiller chassis 16. The tilt shaft extends along the noted horizontal pivot axis 30, which is described herein above with respect to FIG. 2. The tiller chassis 16 is pivotable with respect to the chassis bracket 106 about the noted horizontal pivot axis 30, as illustrated at 28 in FIG. 2, via its connection to the tilt shaft. The chassis bracket 106 is also configured to support the optional components including the adjustment bolt 31 and ratchet lever 33, which facilitate the positional and pivoting movement of the tiller 10, as is conventional and described herein above.

The adjustable mount 100 further includes a locking arrangement (generally referred to at arrow 110 in FIG. 8), which is movable into and between a locked position (see e.g., FIG. 8 and FIGS. 11-13) wherein the chassis bracket 106 and associated tiller chassis 16 remain rotationally fixed with respect to the base bracket 102 and associated outboard motor 12, and an unlocked position (see e.g., FIG. 9) wherein the chassis bracket 106 and tiller chassis 16 are freely movable (e.g., rotatable) with respect to the base bracket 102 and outboard motor 12 about the vertical axis 113. As explained further herein reference to FIGS. 11-13, the locked position can be any one of a plurality of locked positions into and between which the locking arrangement 110 is movable. In each of the locked positions, the chassis bracket 106 and associated tiller chassis 16 extends at a different respective fixed angle with respect to the base bracket 102, thus facilitating the noted operator selection between various left-handed and right-handed angular positions.

In the unlocked position, the chassis bracket 106 is removed from the base bracket 102 and/or manually pivotable with respect to the base bracket 102 about a vertical pivot shaft 124. The construction of the vertical pivot shaft 124 can vary from what is shown. In the illustrated example the vertical pivot shaft 124 includes a fastener (e.g., threaded bolt) that extends through a hole 123 in the base bracket 102 and mates with a corresponding threaded hole 125 (FIG. 10) in the chassis bracket 106.

The locking arrangement 110 includes a locking fastener 112, which couples the chassis bracket 106 to the base bracket 102 in each of the various locked positions. In the illustrated example, the locking fastener 112 is a bolt and a nut; however other types of locking fasteners could be used. Removal of the locking fastener 112 facilitates unlocking of the chassis bracket 106 and base bracket 102, as described further herein below.

The locking arrangement 110 also includes a toe clamp 114, which in the locked position is locked to the base bracket 102 and the chassis bracket 106 by the locking fastener 112. More specifically, as shown by dashed and dotted line in FIGS. 9 and 10, the locking fastener 112 attaches the toe clamp 114 to the base bracket 102 via engagement with a through-hole 111 in the toe clamp 114 and a hole 115 in the base bracket 102. In the unlocked position (FIG. 9), the locking fastener 112 is unthreaded from the threaded hole 115 and the locking fastener 112 and toe clamp 114 are removed from the base bracket 102 and chassis bracket 106.

Figure 9:
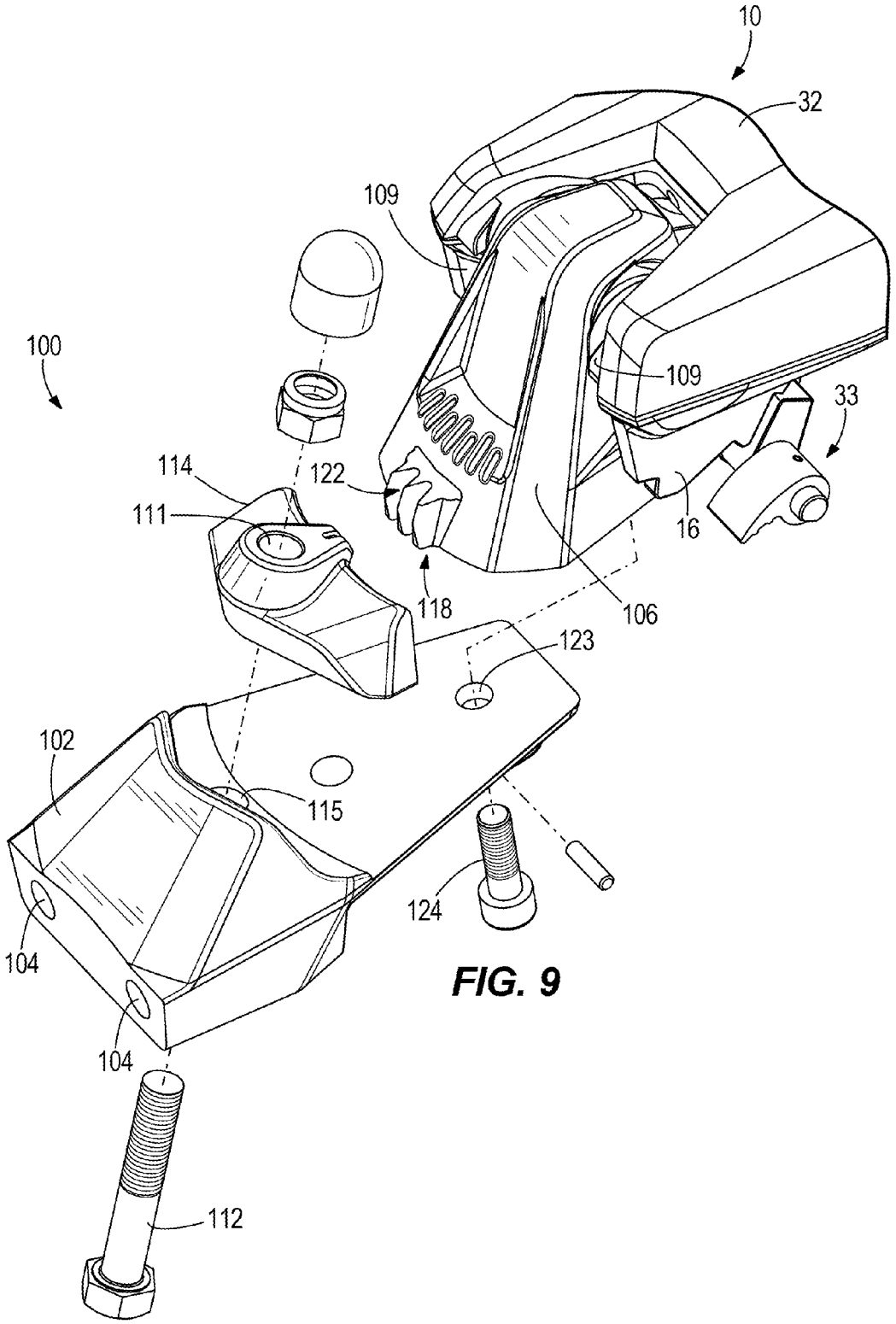
FIG. 9 is an exploded view of the adjustable mount of FIG. 8.
Figure 10:
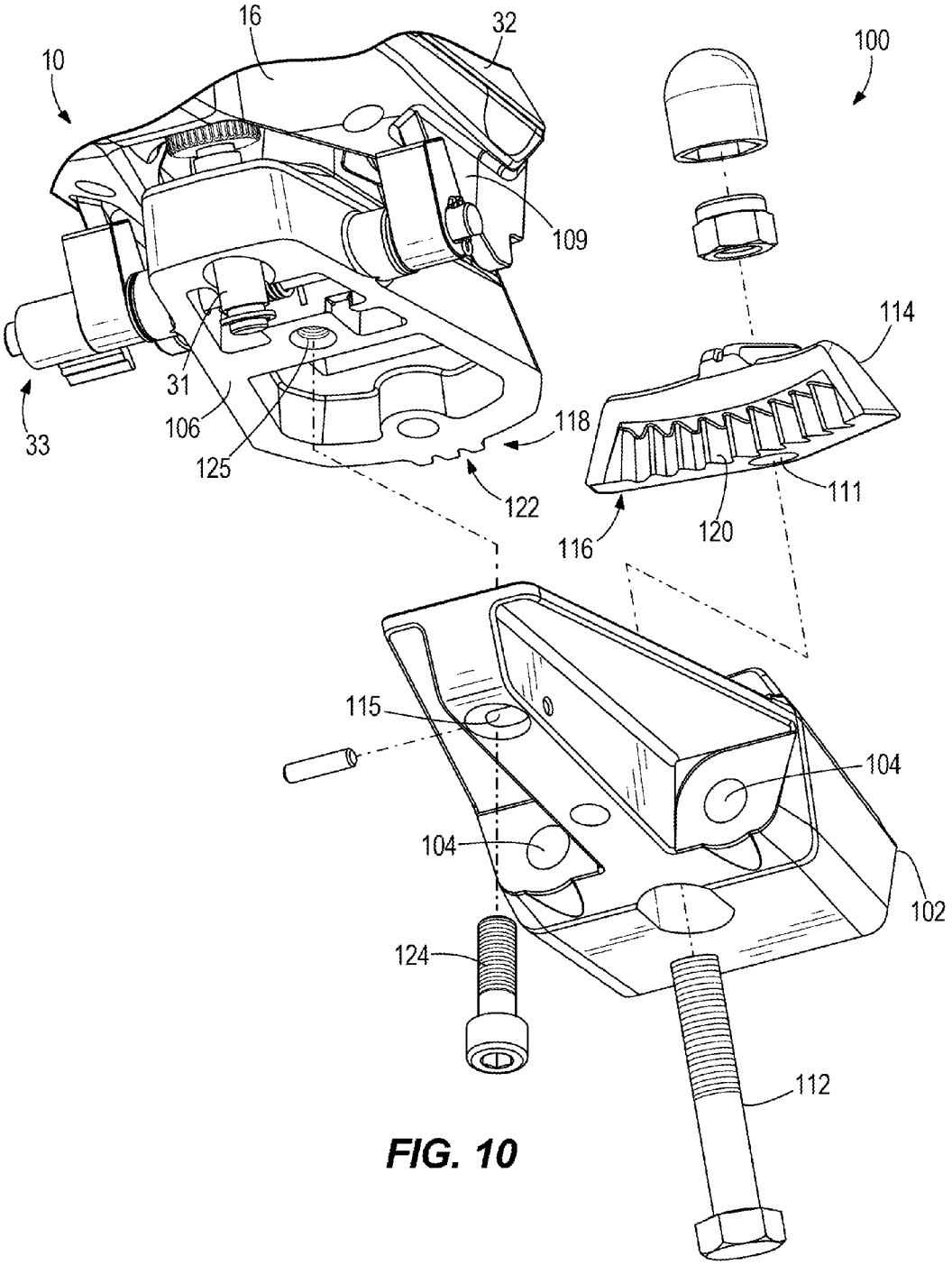
FIG. 10 is another exploded view of the adjustable mount of FIG. 8.
Figures 11, 12, 13:
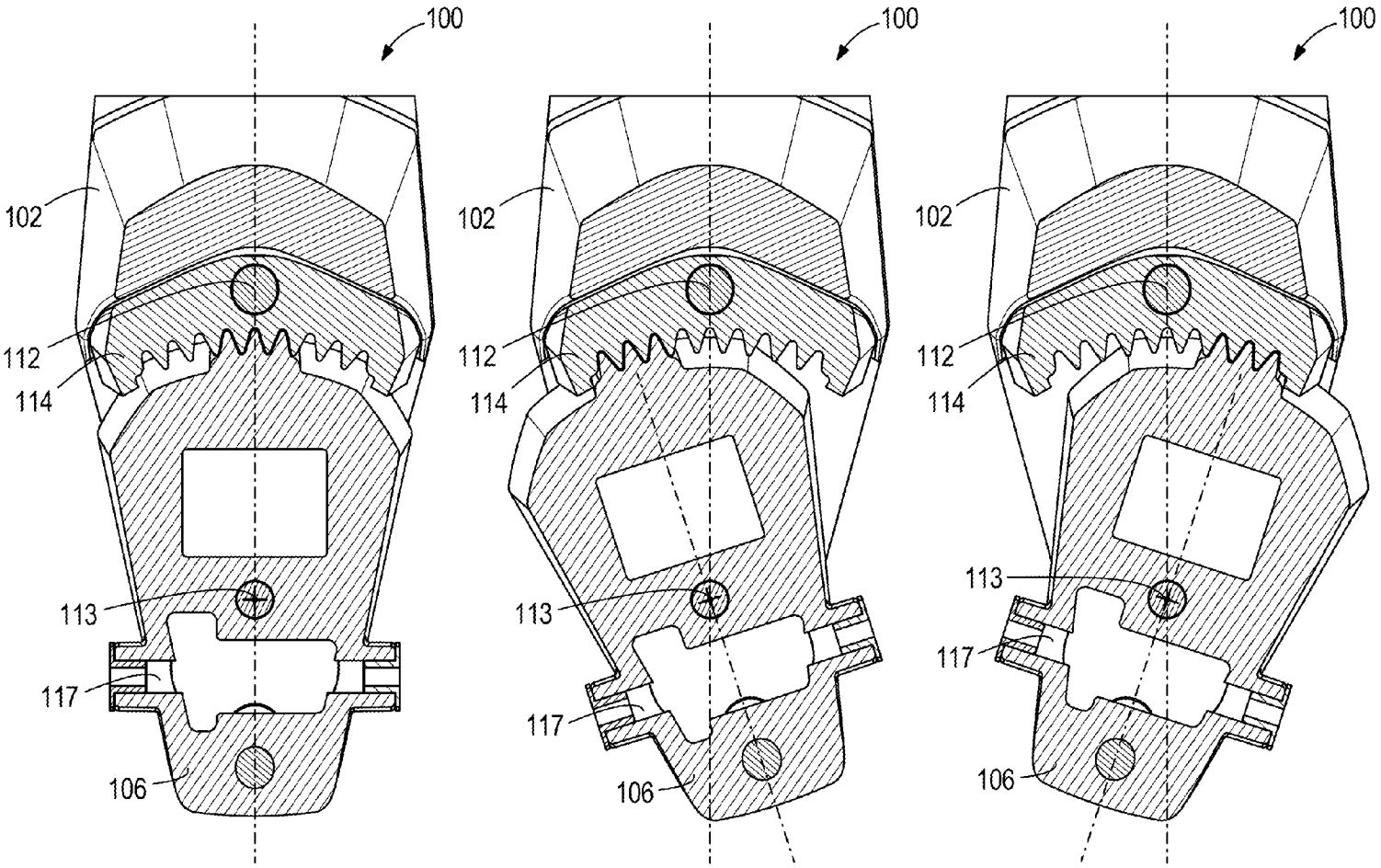
FIGS. 11-13 are sectional views showing the adjustable mount of FIG. 8 in various orientations.

Referring to FIGS. 9 and 10, the locking arrangement 110 also includes a male-female connector having a male portion 116 and a female portion 118, which are configured to mate together in the locked position and disengage from each other in the unlocked position. More specifically, the male-female connector is configured such that when the locking fastener 112 attaches the toe clamp 114 to the base bracket 102, the chassis bracket 106 is engaged by and remains rotationally fixed with respect to the toe clamp 114 and the base bracket 102. FIGS. 11-13 depict the locking arrangement 110 in three exemplary locked positions, including a neutral angle (FIG. 11; i.e., straight ahead from the outboard motor 12); a left-hand angle (FIG. 12; i.e., at an angle towards the port side of the outboard motor 12); and a right-hand angle (FIG. 13; i.e., at an angle towards the starboard side of the outboard motor 12). In each locked position, the male portion 116 is engaged with (e.g., received and retained by) the female portion 118. In the unlocked position, the male portion 116 is removed from (e.g., disengaged with) and thus is not retained by the female portion 118.

The exact location and configuration of the male-female connector can vary from that which is shown. In the illustrated example, the male and female portions 116, 118 are similarly constructed; however in other examples the male and female portions 116, 118 are differently constructed. For discussion purposes, the male portion 116 is disposed on the toe clamp 114 and the female portion 118 is disposed on the base bracket 102; however this is only an example and in other examples, the male portion 116 can be located on the base bracket 102 and the female portion 118 on the toe clamp 114. In other examples, the male-female connector can be located on the base bracket 102 and chassis bracket 106, instead of on the toe clamp 114. Alternate configurations are contemplated by this disclosure and will be apparent to one having ordinary skill in the art in view of the various examples that are further described herein below. For example, see the fourth embodiment, FIGS. 18-20, further explained herein below, which omits the toe bracket and has a differently configured male-female connector.

In the first embodiment shown in FIGS. 8-13, the male portion 116 includes a plurality of recesses and teeth 120 (see FIG. 11) on the front portion of the toe clamp 114 and the female portion 118 includes a plurality of teeth and recesses 122 (see FIG. 9) on the rear portion of the chassis bracket 106. The recesses 122 are aligned next to each other and configured to interlock with the teeth 120 on the toe clamp 114, as shown, for example, in FIGS. 11-13. Each recess 122 corresponds to a different angle at which the chassis bracket 106 and tiller chassis 16 extends from the base bracket 102 and outboard motor 12. This example is not limiting and other examples of male-female connectors are contemplated by the present disclosure, as demonstrated in the below-described second through sixth embodiments.

It will thus be understood by those having ordinary skill in the art that the adjustable mount 100 advantageously facilitates operator-adjustment of the angular orientation of the tiller 10 with respect to the outboard motor 12. This provides both ergonomic and performance advantages over the prior art. According to the first embodiment, the operator can reposition the angle of the tiller 10 to a desired angle by removing the locking fastener 112 from the toe clamp 114 and then removing the toe clamp 114 from engagement with the chassis bracket 106 and base bracket 102. This removes the teeth 120 from the recesses 122 and allows the chassis bracket 106 to be removed from the base bracket 102 and/or pivoted with respect the vertical axis 113 (i.e. pivot about the vertical pivot shaft 124). Once the chassis bracket 106 and associated tiller chassis 16 are repositioned at a desired angle with respect to the base bracket 102 and associated outboard motor 12, the toe clamp 114 can be re-engaged with the base bracket 102 and chassis bracket 106 via engagement between the teeth 120 and recesses 122. Thereafter, the locking fastener 112 can be reengaged with the base bracket 102 and toe clamp 114, thus securing the components together and fixing the tiller 10 at the new desired angle.

Figure 14:
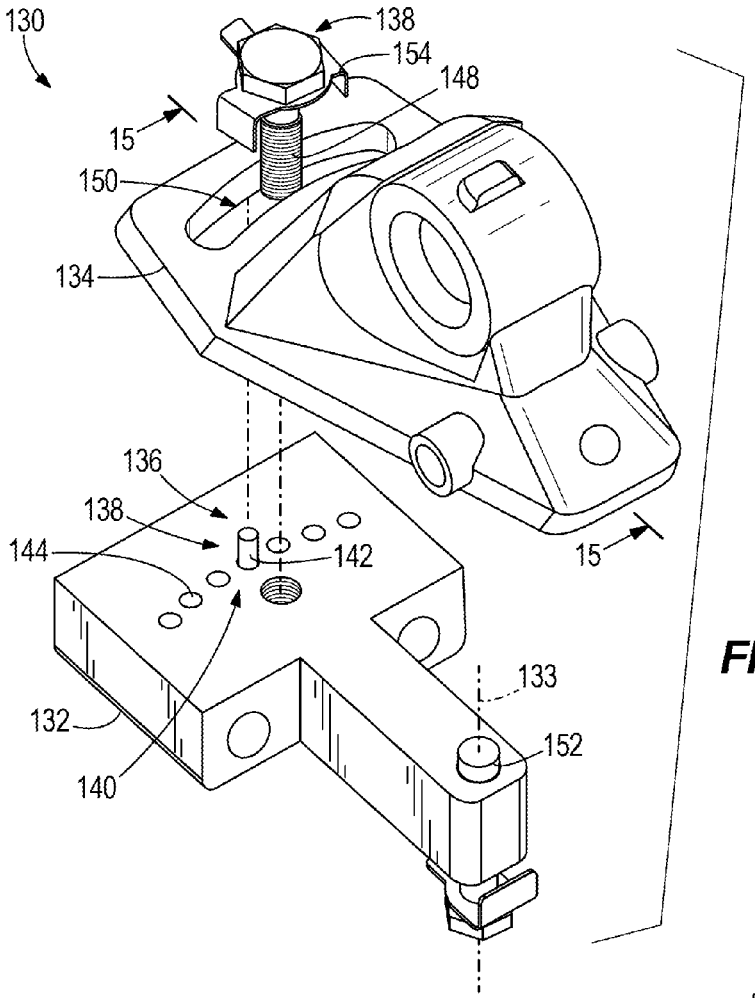
FIG. 14 is an exploded view of a second embodiment of the adjustable mount.
Figure 15:
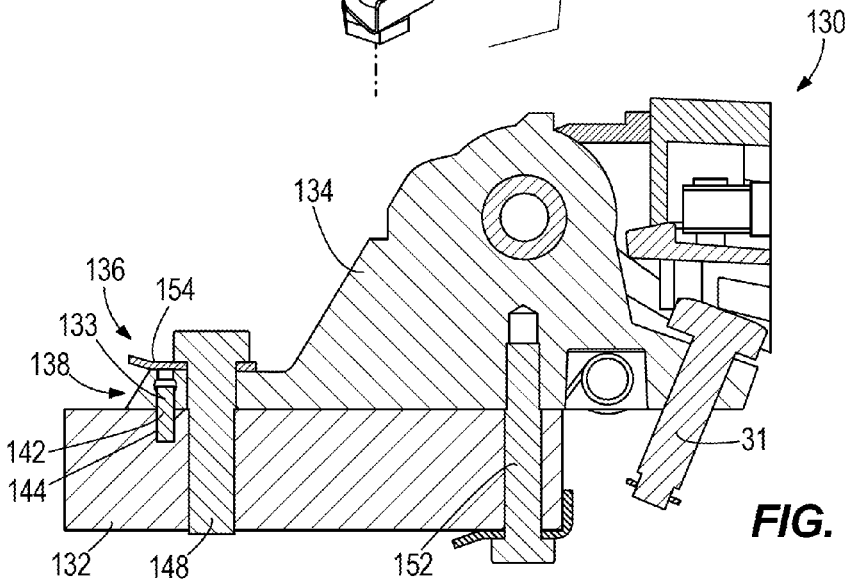
FIG. 15 is a view of section 15-15 taken in FIG. 14.

FIGS. 14 and 15 depict a second embodiment of an adjustable mount 130 for use with the tiller 10 and the outboard motor 12. Similar to the first embodiment, the adjustable mount 130 includes a base bracket 132 configured to be rotationally fixed with respect to the outboard motor 12, a chassis bracket 134 that couples the base bracket 132 to the tiller chassis 16, and a locking arrangement, generally referred to at 136, which is movable into and between a locked position (FIG. 15) wherein the chassis bracket 134 remains rotationally fixed with respect to the base bracket 132, and an unlocked position (FIG. 14) wherein the chassis bracket 134 is freely movable with respect to the base bracket 132 into and out of a plurality of angular positions.

Similar to the first embodiment, the adjustable mount 130 has a vertical pivot shaft 152 that extends along a vertical axis 133, through the base bracket 132 and into the chassis bracket 134. In the unlocked position, the chassis bracket 134 is rotatable with respect to the base bracket 132 about the vertical pivot shaft 152. The locking arrangement 136 includes a male-female connector having a male portion 138 and a female portion 140. In the locked position, the male portion 138 is received and retained by the female portion 140 such that the chassis bracket 134 and associated tiller chassis 16 remain rotationally fixed with respect to the base bracket 132 and associated outboard motor 12. In the unlocked position, the male portion 138 is separated from the female portion 140 such that the chassis bracket 134 and associated tiller chassis 16 can be pivoted about the vertical axis 113 via the vertical pivot shaft 152 and angularly repositioned with respect to the base bracket 132 and associated outboard motor 12.

Unlike the first embodiment, the male portion 138 includes a dowel pin 142 and the female portion 140 includes a plurality of holes 144 formed in the base bracket 132, at least one hole 133 formed in the chassis bracket 134. The male portion 138 further includes a locking fastener 148 that engages with a threaded hole 146 formed in the base bracket 132. In this example the threaded hole 146 is also part of the female portion. The dowel pin 142 is sized and shaped to fit in each of the respective holes 144 and 133. The locking fastener 148 and dowel pin 142 thereby rotationally fix the chassis bracket 134 and base bracket 132 together (see FIG. 15). In use, the operator can adjust the angle at which the chassis bracket 106 and associated tiller chassis 16 extend with respect to the base bracket 132 and associated outboard motor 12 by removing the locking fastener 148 from the threaded hole 146 in the base bracket 132 and then lifting and/or pivoting the chassis bracket 134 off of and/or away from the base bracket 132. Once the chassis bracket 134 is so removed, the operator can manually move the dowel pin 142 to a different selected one of the plurality of holes 144, which each correspond to a different angular position of the chassis bracket 134 and tiller chassis 16. Thereafter, the chassis bracket 134 can be placed back down onto and/or rotated onto the base bracket 132 so that the dowel pin 142 is re-inserted into the hole 133 in the chassis bracket 134. The locking fastener 148 is then re-inserted into the threaded hole 146 via an arc-shaped through-bore 150 in the chassis bracket 134 and tightened down to thereby secure the chassis bracket 134 onto the base bracket 132. A locking washer 154 is disposed on the locking fastener 148 and configured to engage with interior surfaces of the arc-shaped through-bore 150 to further rotationally fix the components together.

Figure 16:
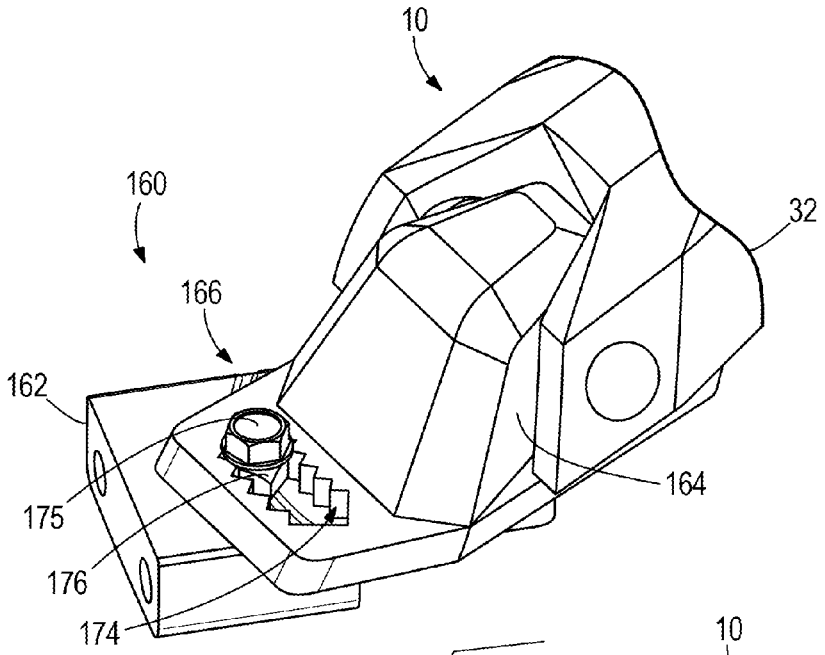
FIG. 16 is a perspective view of a third embodiment of the adjustable mount.
Figure 17:
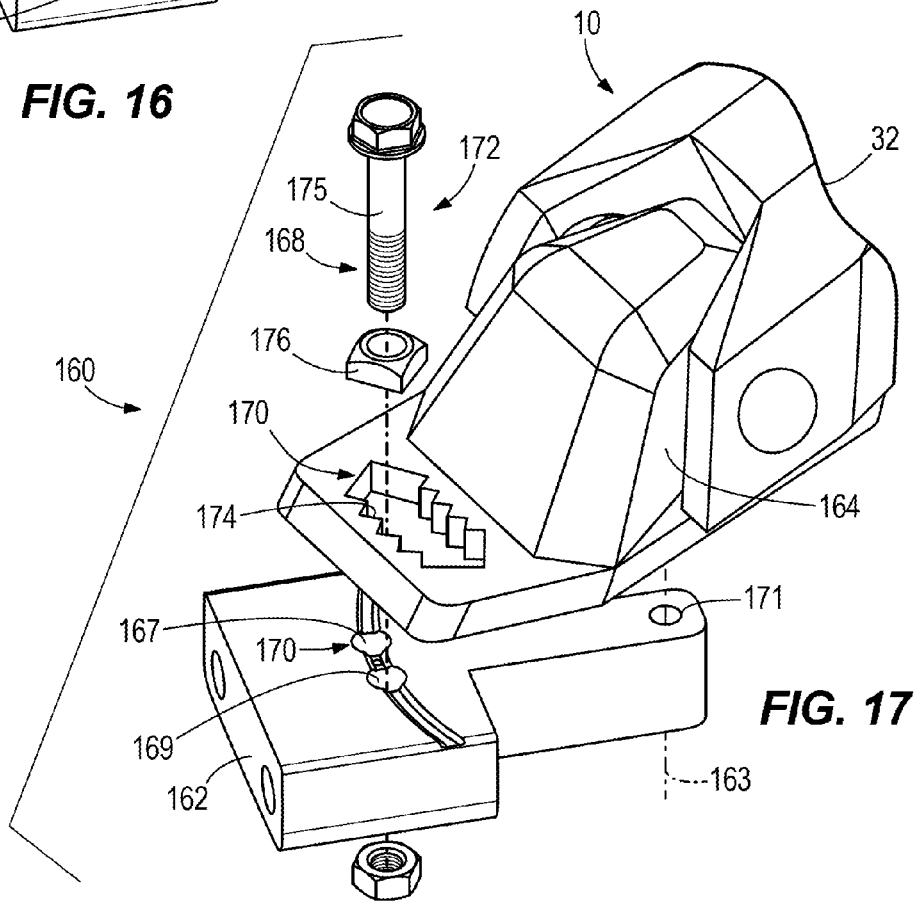
FIG. 17 is an exploded view of the adjustable mount of FIG. 16.

FIGS. 16 and 17 depict a third embodiment of an adjustable mount 160. Similar to the above-described embodiments, the adjustable mount 160 has a base bracket 162 that is configured to be rotationally fixed with respect to the outboard motor 12 and a chassis bracket 164 that is configured to be rotationally fixed with respect to the tiller chassis 16. A locking arrangement, shown generally at 166, is movable into and between a locked position (e.g., FIG. 16) wherein the chassis bracket 164 is rotationally fixed with respect to the base bracket 162 and an unlocked position (FIG. 17) wherein the chassis bracket 164 is freely movable (e.g., rotatable) about a vertical axis 163 with respect to the base bracket 162. Similar to the above-described embodiments, the adjustable mount 160 has a vertical pivot shaft (not shown, but configured similarly to the above-described embodiments) that extends through a hole 171 in the base bracket 162 and a threaded hole (not shown, but configured similarly to the above-described embodiments) in the chassis bracket 164. The chassis bracket 164 is rotatable about the vertical pivot shaft with respect to the base bracket 162 when the locking arrangement 166 is in the unlocked position (FIG. 17). Similar to the above-described embodiments, the locked position is one of a plurality of locked positions into and between which the locking arrangement 166 is movable. In each of the locked positions, the chassis bracket 164 extends at different respective fixed angle with respect to the base bracket 162 and outboard motor 12. Similar to the above-described embodiments, the locking arrangement 166 includes a male-female connector having a male portion 168 and a female portion 170. In the locked position, the male portion 168 is received and retained by the female portion 170. In the unlocked position, the male portion 168 is separated from the female portion 170.

Unlike the above-described embodiments, the male portion 168 of the adjustable mount 160 includes a geometric key 172. The female portion 170 includes a plurality of recesses 174 formed in the chassis bracket 164. Each recess 174 is configured to interlock with the geometric key 172 when the locking arrangement 166 is in one of the plurality of different locked positions. Each recess 174 thus corresponds to a different angular position of the chassis bracket 164 and tiller chassis 16 with respect to the base bracket 162 and outboard motor 12. The geometric key 172 includes a bolt 175 and a locking fastener 176, which is sized and shaped to engage with the recesses 174 to thereby rotationally fix the chassis bracket 164 with respect to the base bracket 162. The female portion 170 further includes a pair of threaded holes 167, 169 in the base bracket 162, each for engaging with the bolt 175 of the geometric key 172. The threaded hole 167 is for engaging the bolt 175 in a left-handed orientation and the threaded hole 169 is for engaging the bolt 175 in a right-handed orientation.

In use, the operator can adjust the fixed angle at which the chassis bracket 164 and associated tiller chassis 16 extends from the base bracket 162 by removing or loosening the bolt 175 from whichever hole 167, 169 it is currently registered and also removing the locking fastener 176 from the recesses 174. With the bolt 175 removed or loosened and the locking fastener 176 removed, the chassis bracket 164 can be manually rotated with respect to the base bracket 162 about the noted vertical pivot shaft. Once the chassis bracket 164 is re-positioned at a desired angle, the bolt 175 can be tightened down until the locking fastener 176 is engaged with a corresponding recess 174, thus locking the chassis bracket 164 with respect to the base bracket 162.

Figure 18:
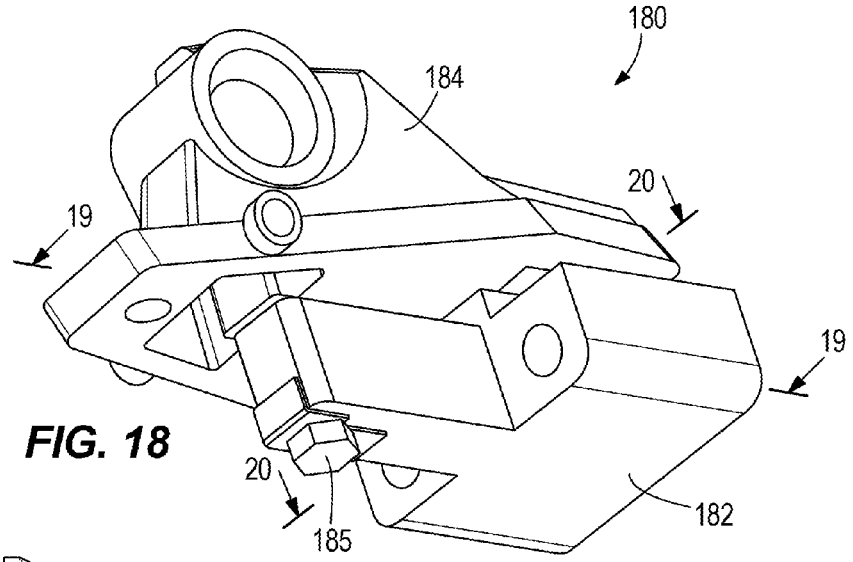
FIG. 18 is a perspective view of a fourth embodiment of the adjustable mount.
Figure 19:
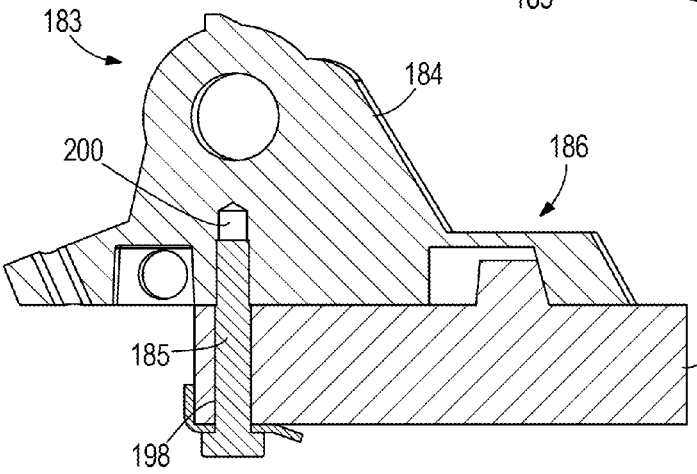
FIG. 19 is a view of section 19-19 taken in FIG. 18.
Figure 20:
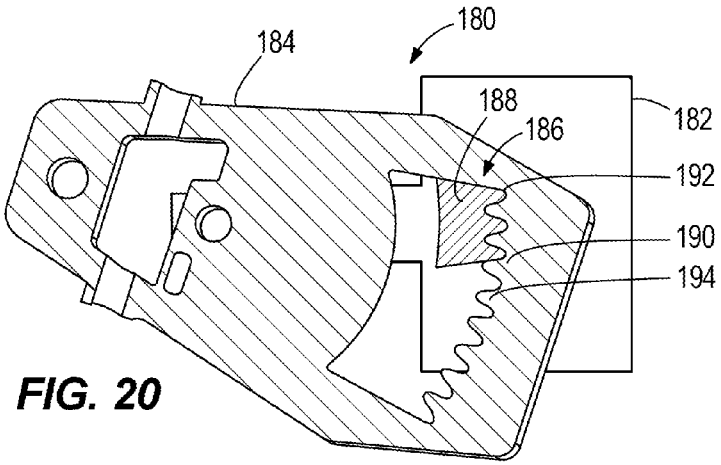
FIG. 20 is a view of section 20-20 taken in FIG. 19.

FIGS. 18-20 depict a fourth embodiment of an adjustable mount 180. Similar to the above-described embodiments, the adjustable mount 180 includes a base bracket 182 configured to be rotationally fixed with respect to the outboard motor 12, a chassis bracket 184 that fixes the base bracket 132 to the tiller chassis 16, and a locking arrangement, generally referred to at 186, which is movable into and between a locked position (FIGS. 18-20) wherein the chassis bracket 184 remains rotationally fixed with respect to the base bracket 182, and an unlocked position (not shown) wherein the chassis bracket 184 is freely movable with respect to the base bracket 182.

Similar to the above-described embodiments, the locking arrangement 186 includes a male-female connector having a male portion 188 and a female portion 190. In the locked position, the male portion 188 is received and retained by the female portion 190 such that the chassis bracket 184 and associated tiller chassis 16 remain fixed with respect to the base bracket 182 and associated outboard motor 12. In the unlocked position, the male portion 188 is separated from the female portion 190 such that the chassis bracket 184 and associated tiller chassis 16 can be moved with respect to the base bracket 182 and associated outboard motor 12.

Similar to the first embodiment described herein with reference to FIGS. 9-13, the male portion 188 includes a plurality of recesses and teeth 192 and the female portion comprises a plurality of teeth and recesses 194 that are configured to interlock with the plurality of teeth 192 when the locking arrangement 136 is in the locked position.

Unlike the first embodiment, the plurality of teeth 192 are disposed on the base bracket 182 and the plurality of recesses 194 are formed in the chassis bracket 184. Each of the recesses 194 corresponds to a different angular position of the chassis bracket 184 and associated tiller chassis 16. A locking fastener 185 extends through a through-bore 198 in the base bracket 182 and into a threaded hole 200 in the chassis bracket 184 to lock the base bracket 182 and chassis bracket 184 in position with respect to each other.

To change the angle at which the chassis bracket 184 and associated tiller chassis 16 extends from the base bracket 182 and associated outboard motor 12, the operator can remove the locking fastener 185 and slide the chassis bracket 184 laterally with respect to the base bracket 182 (see arrow 183), thus removing the recesses 194 from the teeth 192. Thereafter the chassis bracket 184 and associated tiller chassis 16 can be rotated to a desired rotational position. Thereafter, the operator manually slides the chassis bracket 184 laterally with respect to the base bracket 182 (i.e., opposite arrow 183) until the teeth 192 engage with the recesses 194. Once engaged, the operator can insert the locking fastener 185 into the through-bore 198 and tighten it with respect to the threaded hole 200, thereby locking the locking arrangement 186 in the desired locked position.

Figure 21:
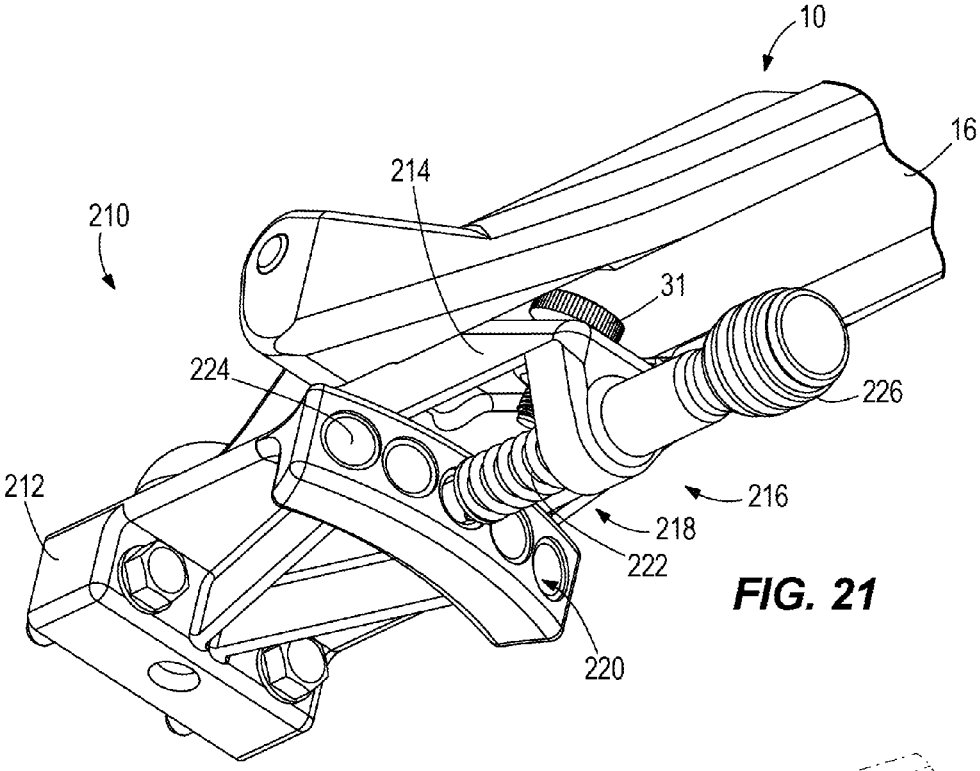
FIG. 21 is a perspective view of a fifth embodiment of the adjustable mount.
Figure 22:
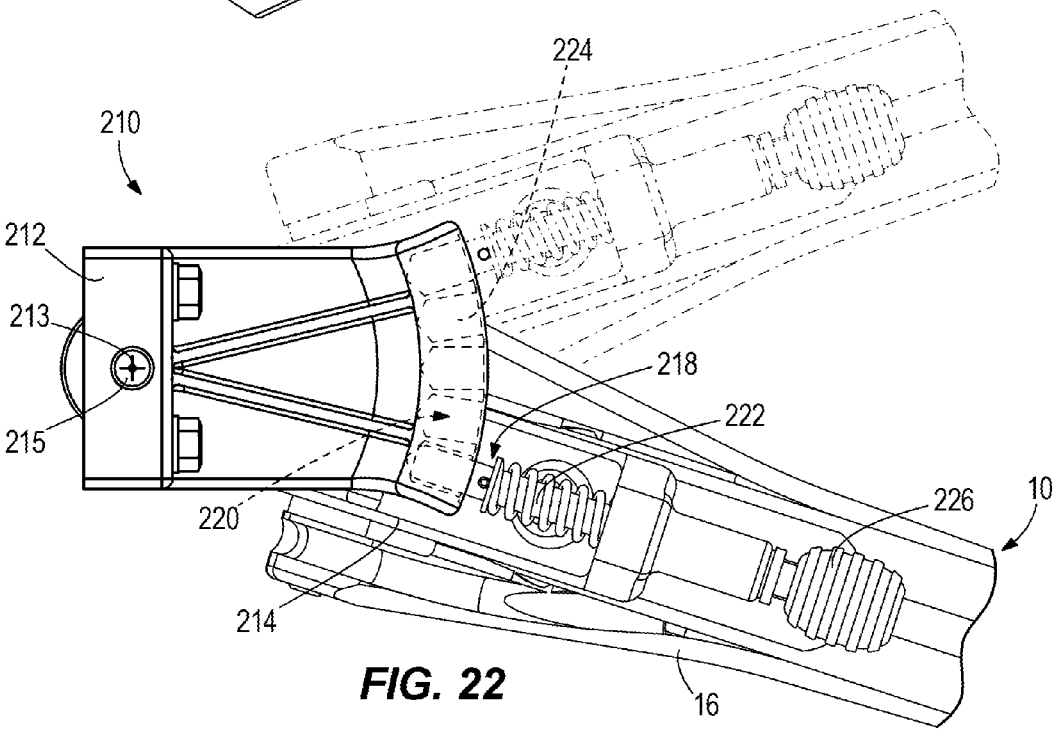
FIG. 22 is a bottom view of the adjustable mount of FIG. 21, showing an alternate position in dashed line format.
Figure 23:
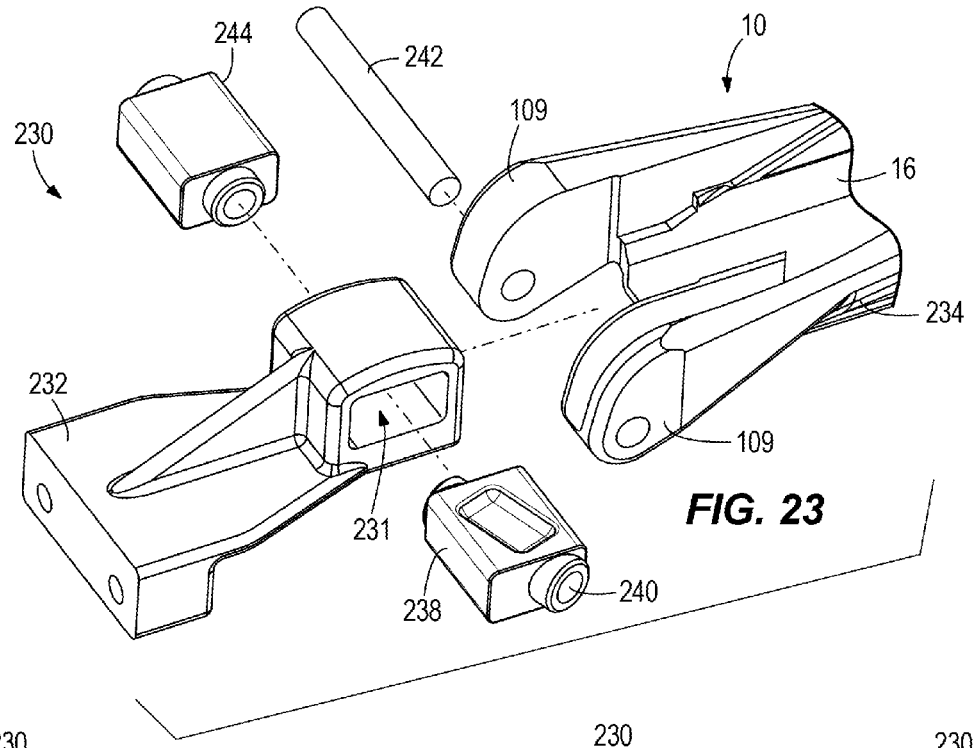
FIG. 23 is an exploded view of a sixth embodiment of the mount.
Figure 24:
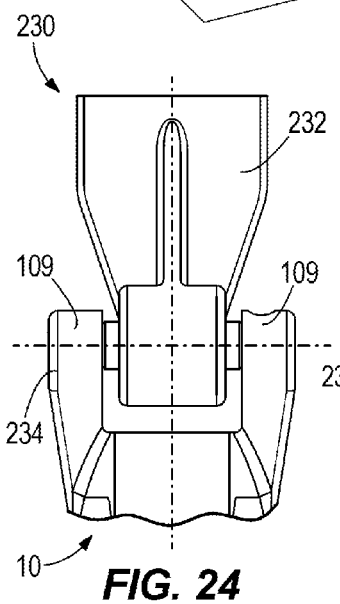
FIGS. 24-26 are sectional views showing the adjustable mount of FIG. 23 in various orientations.
Figure 25:
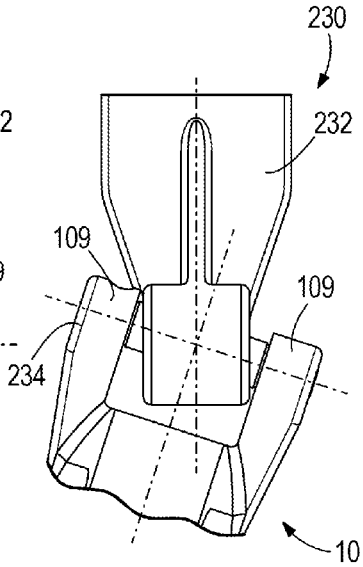
Figure 26:
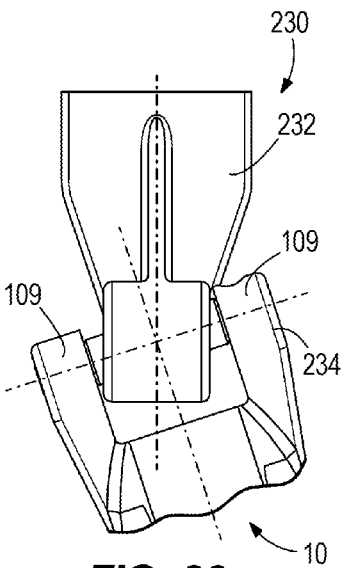

FIGS. 21 and 22 depict a fifth embodiment of an adjustable mount 210. Similar to the above-described embodiments, the adjustable mount 210 includes a base bracket 212 configured to be rotationally fixed with respect to the outboard motor 12, a chassis bracket 214 that is configured to be rotationally fixed with respect to the tiller chassis 16, and a locking arrangement, generally referred to at 216, which is movable into and between a locked position (FIGS. 21 and 22) wherein the chassis bracket 214 remains rotationally fixed with respect to the base bracket 212, and an unlocked position (not shown) wherein the chassis bracket 214 is freely movable with respect to the base bracket 212.

Similar to the above-described embodiments, a vertical pivot shaft 215 extends along a vertical pivot axis 213, through the base bracket 212 and into the chassis bracket 214. In the unlocked position, the chassis bracket 214 is rotatable with respect to the base bracket 212 about the vertical pivot shaft 215. Similar to the first embodiment, the locking arrangement 216 includes a male-female connector having a male portion 218 and a female portion 220. In the locked position, the male portion 218 is received and retained by the female portion 220 such that the chassis bracket 214 and associated tiller chassis 16 remain fixed with respect to the base bracket 212 and associated outboard motor 12. In the unlocked position, the male portion 218 is separated from the female portion 220 such that the chassis bracket 214 and associated tiller chassis 16 can be pivoted about the vertical pivot axis 213 with respect to the base bracket 212 and associated outboard motor 12.

Unlike the above-described embodiments, the male portion 218 includes a spring-loaded pin 222 and the female portion comprises a plurality of holes 224 that are sized and shaped to receive the spring-loaded pin 222. Each hole 224 corresponds to a different angular position of the chassis bracket 214 and tiller chassis 16 with respect to the base bracket 212 and associated outboard motor 12. A handle 226 is coupled to the spring-loaded pin 222 and configured such that manually pulling on the handle 226 compresses the spring-loaded pin 222 against the chassis bracket 214 and removes the spring-loaded pin 222 from the hole 224 in which the spring-loaded pin 222 resides. Removing the spring-loaded pin 222 from the noted hole 224 unlocks the chassis bracket 214 from the base bracket 212 such that the chassis bracket 214 and associated tiller chassis 16 can be manually pivoted about the vertical pivot axis 213 until a different one of the holes 224 is aligned with the spring-loaded pin 222. Once the tiller chassis 16 is oriented into a desired angle with respect to the base bracket 212 and associated outboard motor 12, the handle 226 can be manually released, which allows the spring-loaded pin 222 to resiliently spring back into a locked position wherein the spring-loaded pin 222 engages with the aligned hole 224.

FIGS. 23-26 depict a sixth embodiment of an adjustable mount 230. The adjustable mount 230 includes a base bracket 232 configured to be rotationally fixed with respect to the outboard motor 12 and a locking arrangement, generally referred to at 236. The locking arrangement includes a bushing 238 that is configured for mounting in a channel 231 in the base bracket 232 in a first position (FIG. 25) wherein the bushing 238 is configured to couple the chassis bracket 234 to the base bracket 232 such that the chassis bracket 234 extends at a first angle with respect to the base bracket 232. The bushing 238 is also configured for mounting in the channel 231 in the base bracket 232 in an alternate, second position (FIG. 26) wherein the bushing 238 couples the chassis bracket 234 to the base bracket 232 at a different, second angle (in this example, an opposite angle) with respect to the base bracket 232. The configuration of the bushing 238 can vary from that which is shown. In the illustrated example, the bushing 238 includes an angled through-bore 240 that receives and retains a tilt shaft 242 onto which the chassis bracket 234 is mounted via the above-described opposing arms 109. Optionally, the locking arrangement 236 includes a second bushing 244 configured for mounting on the base bracket 232. The second bushing 244 couples the chassis bracket 234 to the base bracket 232 at a neutral angle (see FIG. 24), which is between the first and second angles.

In use, the locking arrangement 236 advantageously provides a kit by which the operator can easily select between several different mounting angles (FIGS. 24-26) by removing the bushing 238 from the channel 231 and re-inserting it in a different orientation. Alternately, the operator can select a different bushing (e.g. bushing 244), which provides a further different angle. Optionally, the bushings 238, 244, etc. can be made of a polymer/rubber material to provide better vibration isolation of the handle. The bushings 238, 244, etc. can also utilize ribs, holes, or other features to further enhance the vibration isolation characteristics of the bushing.

The orientation and configuration of the channel 231 and bushings 238, 244 can vary from that which is shown. For example, instead of being oriented transversely to the steering arm, the channel 231 can be axially aligned with the steering arm. In such an example, the bushings 238, 244, etc. can be axially inserted into and nest in the channel 231 and further provide the above-described angled through-bore 240 for receiving the tilt shaft 242. Flipping the orientation of the bushing 238, 244, etc. 180° thus provides alternate mounting arrangements, similar to the embodiment shown.

Advantageously, several of the examples described herein above allow the operator to optimize the ergonomics of the tiller for specific boat set-up and hand preference. Several of the examples do not require removal of components to make this adjustment. Advantageously, several of the examples provide early indication if for example a fastener loosens, as the steering response may become somewhat sloppy, however, control will still be provided. Several of the examples provide redundant security of adjustment. For example, if a fastener disengages, the locking mechanism typically will still allow control without excessive free play. High resolution adjustment is thus contained within a compact volume.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A tiller for an outboard motor, the tiller comprising a tiller chassis; a base bracket configured to be rotationally fixed with respect to the outboard motor; a chassis bracket that couples the base bracket to the tiller chassis; and a locking arrangement that is movable into and between a locked position wherein the chassis bracket is rotationally fixed to the base bracket, and an unlocked position wherein the chassis bracket is freely rotatable with respect to the base bracket about a vertical axis when the tiller is in a horizontal position;

wherein the locked position is one of a plurality of locked positions into and between which the locking arrangement is movable, and wherein in each of the plurality of locked positions, the chassis bracket extends at a different respective fixed angle with respect to the base bracket;

wherein the locking arrangement comprises a male-female connector having a male portion and a female portion, wherein in the locked position the male portion is received by the female portion, and wherein in the unlocked position the male portion is separated from the female portion; and wherein the male portion comprises a plurality of teeth and wherein the female portion comprises a plurality of recesses that are configured to interlock with the plurality of teeth when the locking arrangement is in the locked position.

2. A tiller for an outboard motor, the tiller comprising a tiller chassis; a base bracket configured to be rotationally fixed with respect to the outboard motor; a chassis bracket that couples the base bracket to the tiller chassis; and a locking arrangement that is movable into and between a locked position wherein the chassis bracket is rotationally fixed to the base bracket, and an unlocked position wherein the chassis bracket is freely rotatable with respect to the base bracket about a vertical axis when the tiller is in a horizontal position;

wherein the locked position is one of a plurality of locked positions into and between which the locking arrangement is movable, and wherein in each of the plurality of locked positions, the chassis bracket extends at a different respective fixed angle with respect to the base bracket;

wherein the locking arrangement comprises a male-female connector having a male portion and a female portion, wherein in the locked position the male portion is received by the female portion, and wherein in the unlocked position the male portion is separated from the female portion;

wherein the male portion comprises a geometric key and wherein the female portion comprises a plurality of recesses that are each configured to interlock with the geometric key when the locking arrangement is in one of the plurality of locked positions; and wherein the geometric key comprises a threaded fastener that couples the chassis bracket to the base bracket via engagement with the female portion.

3. A tiller for an outboard motor, the tiller comprising a tiller chassis; a base bracket configured to be rotationally fixed with respect to the outboard motor; a chassis bracket that couples the base bracket to the tiller chassis; and a locking arrangement that is movable into and between a locked position wherein the chassis bracket is rotationally fixed to the base bracket, and an unlocked position wherein the chassis bracket is freely rotatable with respect to the base bracket about a vertical axis when the tiller is in a horizontal position;

wherein the locked position is one of a plurality of locked positions into and between which the locking arrangement is movable, and wherein in each of the plurality of locked positions, the chassis bracket extends at a different respective fixed angle with respect to the base bracket;

wherein the locking arrangement comprises a male-female connector having a male portion and a female portion, wherein in the locked position the male portion is received by the female portion, and wherein in the unlocked position the male portion is separated from the female portion;

wherein the male portion comprises a locking pin and wherein the female portion comprises a plurality of holes that are each configured to receive the locking pin when the locking arrangement is in one of the plurality of locked positions;

a spring, wherein in the locking position the spring biases the locking pin towards the plurality of holes, and wherein in the unlocked position the locking pin is manually removed from the plurality of holes, against the spring.

4. A tiller for an outboard motor, the tiller comprising a tiller chassis; a base bracket configured to be rotationally fixed with respect to the outboard motor; a chassis bracket that couples the base bracket to the tiller chassis; and a locking arrangement that is movable into and between a locked position wherein the chassis bracket is rotationally fixed to the base bracket, and an unlocked position wherein the chassis bracket is freely rotatable with respect to the base bracket about a vertical axis when the tiller is in a horizontal position;

a locking fastener that couples the chassis bracket to the base bracket in the locked position; and a toe clamp, wherein the locking fastener couples the toe clamp to the base bracket such that the chassis bracket is engaged by and remains rotationally fixed with respect to the toe clamp and the base bracket.

5. The tiller according to claim 4, wherein the locking arrangement further comprises a male-female connector having a male portion and a female portion, wherein in the locked position the male portion is received by the female portion and wherein in the unlocked position the male portion is removed from the female portion.

6. The tiller according to claim 5, wherein one of the male portion and the female portion is located on the toe clamp and wherein the other of the male portion and female portion is located on the base bracket.

7. The tiller according to claim 6, the male portion comprises a plurality of teeth and wherein the female portion comprises a plurality of recesses that are configured to interlock with the plurality of teeth when the locking arrangement is in each of the plurality of locked positions.

8. The tiller according to claim 5, wherein one of the male portion and the female portion is located on the base bracket and wherein the other of the male portion and the female portion is located on the chassis bracket.

9. The tiller according to claim 8, wherein the male portion comprises a plurality of teeth and wherein the female portion comprises a plurality of recesses that are configured to interlock with the plurality of teeth when the locking arrangement is in each of the plurality of locked positions.

10. A tiller for an outboard motor, the tiller comprising a tiller chassis; a base bracket configured to be rotationally fixed with respect to the outboard motor; a chassis bracket that couples the base bracket to the tiller chassis; and a locking arrangement that is movable into and between a locked position wherein the chassis bracket is rotationally fixed to the base bracket, and an unlocked position wherein the chassis bracket is freely rotatable with respect to the base bracket about a vertical axis when the tiller is in a horizontal position;

wherein the male portion comprises a spring-loaded pin and the female portion comprises a plurality of holes that are configured to receive the spring-loaded pin.

11. The tiller according to claim 10, further comprising a handle coupled to the spring-loaded pin, wherein manually moving the handle to compress the spring-loaded pin removes the spring-loaded pin from the plurality of holes and wherein manually releasing the handle causes the spring-loaded pin to bias back towards the plurality of holes.

12. A tiller for an outboard motor comprising:

a base bracket that is configured to be rotationally fixed with respect to the outboard motor;

a chassis bracket that is coupled to the base bracket; and a locking arrangement that is movable into and between a locked position wherein the chassis bracket is locked to and rotates together with the base bracket, and an unlocked position wherein the chassis bracket is freely rotatable with respect to the base bracket about a vertical axis when the tiller is in a horizontal position;

wherein the locking arrangement further comprises a base bracket that is fixed to the steering arm and a chassis bracket that is fixed to the chassis bracket, wherein in the locked position, the locking arrangement rotationally locks the chassis bracket to the base bracket, and wherein in the unlocked position, the locking arrangement permits the chassis bracket to freely rotate with respect to the base bracket;

wherein the locking arrangement further comprises a locking fastener that couples the chassis bracket to the base bracket in the locked position;

wherein the locking arrangement further comprises a toe clamp, wherein the locking fastener couples the toe clamp to the base bracket such that the chassis bracket is sandwiched between the toe clamp and the base bracket;

wherein the locking arrangement further comprises a male-female connector having a male portion and a female portion, wherein in the locked position the male portion is received by the female portion and wherein in the unlocked position the male portion is removed from the female portion; and wherein one of the male portion and the female portion is located on the toe clamp and wherein the other of the male portion and female portion is located on the base bracket.

13. A tiller for an outboard motor, the tiller comprising:

a tiller chassis;

a base bracket that is configured to be rotationally fixed with respect to the outboard motor; and a bushing that is configured for mounting on the base bracket in a first position wherein the bushing couples the tiller chassis to the base bracket such that the tiller chassis extends at a first angle with respect to the base bracket;

wherein the bushing is configured for mounting on the base bracket in an alternate, second position wherein the bushing couples the tiller chassis to the base bracket at a different, second angle with respect to the base bracket.

14. The tiller according to claim 13, wherein the bushing comprises a through-bore that is configured to receive a tilt shaft onto which the chassis bracket is mounted.

15. The tiller according to claim 14, further comprising a second bushing configured for mounting on the base bracket, wherein the second busing couples the tiller chassis to the base bracket at a neutral angle that is between the first and second angles.

* * * * *